United States Patent [19]

Kohno et al.

[11] 4,364,684

[45] Dec. 21, 1982

[54] WRITING INSTRUMENT

[75] Inventors: Tadashi Kohno, Ishioka; Takahiko Shimizu, Tokyo; Kenji Takahashi, Soka; Hishao Fukui, Tokyo; Akio Okubo; Noriaki Masuda, both of Tsuchiura, all of Japan

[73] Assignee: Pentel Kabushiki Kaisha, Tokyo, Japan

[21] Appl. No.: 158,387

[22] Filed: Jun. 11, 1980

[30] Foreign Application Priority Data

| | | | |
|---|---|---|---|
| Jun. 21, 1979 | [JP] | Japan | 54-85107[U] |
| Jun. 21, 1979 | [JP] | Japan | 54-85108[U] |
| Dec. 25, 1979 | [JP] | Japan | 54-179590[U] |
| Jan. 24, 1980 | [JP] | Japan | 55-7355[U] |
| Jan. 31, 1980 | [JP] | Japan | 55-11135[U] |

[51] Int. Cl.[3] ..... B43K 3/04

[52] U.S. Cl. ..... 401/264; 401/273; 401/292

[58] Field of Search ..... 401/220, 273, 264, 206, 401/235

[56] References Cited

U.S. PATENT DOCUMENTS

| | | | |
|---|---|---|---|
| 1,340,028 | 5/1920 | Erwin | 401/264 |
| 1,394,139 | 10/1921 | Bright, Jr. | 401/206 |
| 1,465,845 | 8/1923 | Evans | 401/264 |
| 2,029,152 | 1/1936 | Bonkowski | 401/292 |
| 2,459,584 | 1/1949 | Quan | 401/292 |
| 2,575,180 | 11/1951 | Lurz | 401/264 |
| 2,663,040 | 12/1953 | Leckler | 401/206 |
| 2,695,737 | 11/1954 | Schlicksupp | 401/264 |
| 2,783,488 | 3/1957 | Jockers | 401/206 |
| 3,095,598 | 7/1963 | Gonnella et al. | 401/220 |
| 3,153,804 | 10/1964 | Silver | 401/206 |
| 3,298,055 | 1/1967 | Schwartzman | 401/206 |
| 3,468,611 | 9/1969 | Ward | 401/206 |
| 3,778,495 | 12/1973 | Woolley | 401/292 |
| 4,238,161 | 12/1980 | Morohashi | 401/264 |

FOREIGN PATENT DOCUMENTS

| | | | |
|---|---|---|---|
| 936960 | 2/1948 | France | 401/264 |

*Primary Examiner*—William Pieprz

*Attorney, Agent, or Firm*—Wenderoth, Lind & Ponack

[57] ABSTRACT

A writing instrument comprises a writing nib having a writing tip at one end and an enlarged head portion at the other end, and a resilient seat urging the head portion of the nib toward a tip of the instrument. The nib is movably secured in a nib holder body in such a manner that a writing pressure enables the nib to move backward against the resilient force of the seat to form an ink-feed space between the head portion and the nib holder body. When the writing instrument is not in use, the head portion is engaged with the nib holder body to close the ink-feed space.

9 Claims, 19 Drawing Figures

WRITING INSTRUMENT

BACKGROUND OF THE INVENTION

The present invention relates to a writing instrument of the kind comprising an ink reservoir and a nib holder adapted to support a writing nib at one end of the reservoir and positioned to receive ink by capillary action from an ink carrier housed in the reservoir, and more particularly to an improved structure of the writing nib and elements associated thereto.

SUMMARY OF THE INVENTION

An object of the present invention is to provide a writing instrument including a new and improved structure of nib and associated elements which can prevent ink from lowering or retracting to a reservoir when the writing instrument is maintained with its tip facing upward.

Another object of the invention is to provide a nib structure for a writing instrument of the kind referred to which ensures immediate, continuous and, smooth flow of ink when the writing instrument is in a writing posture.

Another object of the present invention is to provide a writing instrument including a new type of nib structure and associated parts, which is economical to produce and which is very effective for the purposes intended.

According to the present invention, a writing instrument of the kind comprising an ink reservoir and a nib holder adapted to support the nib at one end of the reservoir comprises an elongated nib having an enlarged head portion at one end thereof and a writing tip at the other end, an ink-permeable resilient seat member resiliently contactable with the head portion of the nib and adapted to draw ink from the ink reservoir, the nib being slidable relative to the nib holder so that a writing pressure enables the nib to move backward to form an ink-feed space between the head portion and the nib holder against the resilient force of the ink-permeable resilient member.

The nib may have a plurality of grooves extending along the entire length except at the head portion.

The ink-permeable resilient member may be formed integral with an ink-feed member interposed between the writing nib and the ink reservoir.

Further, the ink-permeable resilient member may be formed with two parts, one of which has a high resiliency relative to the other. These two parts may be formed in integral.

DETAILED DESCRIPTION OF THE INVENTION

Figure 1:
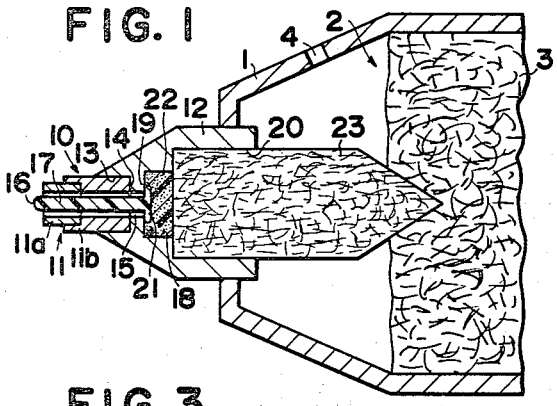
FIG. 1 is an enlarged sectional view of a part of a writing instrument, embodying the present invention.

Referring to the drawings, wherein like parts are designated by the same reference numerals throughout the various figures, a writing instrument includes an elongated hollow barrel or casing generally indicated by the numeral 1, only a part of which is shown since the other part can be understood as being quite similar to the structure of conventional writing instruments and since the other part is not related to the subject matter of the present invention. The barrel 1 forms an ink reservoir 2, and an elongated ink carrier or filler 3 made of ink absorbent materials is housed in the reservoir 2. The ink carrier 3 is preferably made of a material such as felt capable of storing a large quantity of ink and is of generally circular cross section. Though not shown, the rear end of the barrel is closed, for example, by a plug held in place by a press fit. The barrel 1 has an air vent 4 at a fore end portion.

Referring first to FIG. 1, the nib holder, which is generally designated by the numeral 10, has a holder tube 11 having a ring shaped tip **11*a* of hard material such as a ceramic and a pipe 11*b* of a stainless steel, and a conical holder 12 made of suitable steel or synthetic resin. The ring shaped tip 11*a* and the pipe 11*b* are connected together as illustrated by a suitable adhesive agent, and the pipe 11*b* is fixed in a concave recess 13 of the holder 12 such that the end of the pipe 11*b* abuts against a shoulder 14 of the holder. Reference numeral 15 represents an aperture or through-hole formed axially in the holder 12, for slidably securing a writing nib 17, which will be described, in combination with the holder tube 11. The holder 12 has, in continuation with the through hole 15, a circular or cylindrical concave portion 18 which is larger in diameter than the through-hole 15 to form a shoulder 19, and a circular or cylindrical recess 20 having a diameter larger than that of the concave portion 18. An ink-feed core 23 which is made of a bundle of synthetic fibers is held at its fore end portion within the recess 20 and extends into the ink carrier 3 so that ink may be fed toward the writing nib from the ink carrier 3. The core 23 may be made of sintered plastics or porous ceramics. The elements 11*a* and 11*b*** may be connected together by a suitable method such as caulking or press fitting.

The writing nib 17, which is made of a suitable resin such as polyacetal but may be made of a metal such as stainless steel has an enlarged portion or head 21, the head 21 being circular in cross section and having a diameter larger than the diameter of the through-hole 15 of the holder 12. The writing nib 17 is inserted into and slidably secured within the through-hole 15 and extended through the holder tube 11 with a small space being present between the writing nib 17 and the inner wall of the through-hole 15 and the holder tube 11. The head 21 of the writing nib 17 may be formed in any desired configuration or shape, as illustrated in FIGS. 6A–6C, but it is preferred that the head 21 be contacted with the shoulder 19 of the holder 12 in a facewise or surface-contact manner when the writing nib is urged forwardly by the resilient force of an ink-permeable resilient member 22 which will be described later.

When the head 21 is engaged with the shoulder 19 of the holder 12, an ink feeding channel formed with the through-hole 15 and the concave portion 18 will be completely closed. When the writing nib 17 is retracted against the resilient force of the ink-permeable resilient member 22 by a writing pressure applied to a tip 16 of the writing nib 17, a gap (not shown) will be formed between the head 21 and the shoulder 19 so that an ink feed channel may be produced. In order to ensure the formation of this gap, the tip 16 is projected a sufficient distance outwardly from the end of the ring shaped tip 11*a*.

Provided within the concave portion 18 of the holder 12 is an ink-permeable resilient seat member 22, which is in the form of a block-like member of suitable shape and is made of desired foamed plastics of an open cell type to have suitable resiliency and elastic properties. The ink-permeable resilient seat member 22 is resiliently contacted with the head 21 of the writing nib 17 so that the head 21 until always abut against the shoulder 19 when the writing instrument is not in use.

Figure 6A:
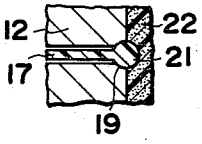
FIGS. 6A, 6B and 6C are sectioned views of parts of writing nibs, showing modified forms of the writing nib.
Figure 6B:
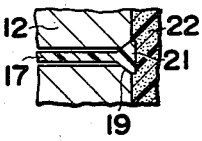
Figure 6C:
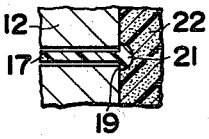

FIGS. 6A, 6B and 6C show various alternative structures of the head 21 of the writing nib such as spherical, conical and semi-spherical. The head 21 may be formed in any other shape, but the shoulder 19 of the holder 12 is always designed to meet with the shape of the head so that a surface contact (i.e., facewise abutment) can be obtained between the shoulder 19 and the head 21. Namely, the shoulder 19 should be designed in accordance with the shape of the head 21.

Figure 7:
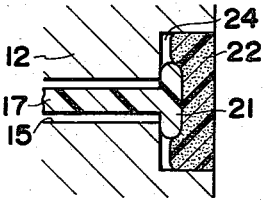
FIG. 7 is an enlarged sectional view of the writing nib, showing the relationship of the writing nib and elements associated thereto.

FIG. 7 is an enlarged sectional view of a part of the elements shown in FIG. 1. As illustrated, an ink space 24 is possibly formed in adjacent to the head 21 of the writing nib 17 when the elements are assembled. A traversing or lengthwise movement of the writing nib 17 causes a deformation of the ink-permeable resilient member 22, resulting in a change of volume of the ink space 24. This functions as a pumping operation and facilitates a continuous and constant feeding of ink towards the tip 16 of the writing nib.

In the structure of the inventive writing instrument, the ink filled in the space between the writing nib 17 and the inner walls of the holder tube 11 and of the through-hole 15 is maintained in this space even when the writing instrument 1 is in an upright position with the tip 16 of the nib facing upward.

Figure 2A:
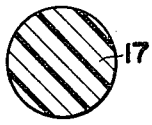
FIGS. 2A and 2B are sectioned views of writing nibs according to embodiments of the invention.
Figure 2B:
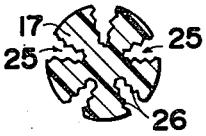

FIGS. 2A and 2B show desired cross sectional shapes of the writing nib, in which FIG. 2A shows a circular cross sectional shape and FIG. 2B a circular cross sectional shape with radial grooves 25. In FIG. 2B, the writing nib 17 has a plurality of grooves radially and constantly formed along a substantial length of the nib except for the head 21. The groove 25 has wave-shaped or zig-zag wall surfaces 26 as illustrated. The applicants have found that the structure of FIG. 2B exhibits a desired effect of continuous feeding of ink and avoids an undesired overflow or dropping of ink.

Figure 3:
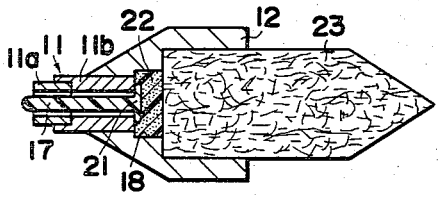
FIG. 3 is a sectioned view of a part of a writing instrument according to another embodiment of the invention.
Figure 4:
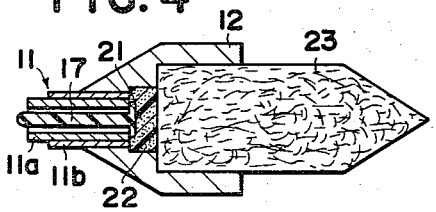
FIG. 4 is a sectioned view of a part of a writing instrument according to a further embodiment of the invention.
Figure 5:
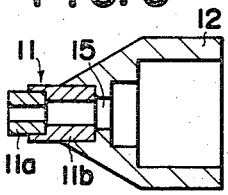
FIG. 5 is a sectioned view of a part of a writing instrument showing a modified structure of a nib holder tube.

FIGS. 3, 4 and 5 show modified configurations of the writing instrument of FIG. 1, particularly of nib holder 12. In FIG. 3, a tube 11*b* of a holder tube 11 extends to a concave portion 18 of a holder 12 and does not have the shoulder 19 of the embodiment in FIG. 1. Thus, it is the end of the tube 11*b* which will abut against or contact with the head portion 21 of the writing nib 17. FIG. 4 shows a modified structure in which both the ring shaped member 11*a* and tube 11*b* are extended to the concave portion 18 such that the head 21 of the writing nib can contact with an end of the extended ring shaped member 11*a*. Other elements are substantially similar in structure with those of FIG. 1 and a further detailed description will not be made. FIG. 5 shows a further modification in which a tube 11*b* has a inner diameter smaller than the diameter of the through-hole 15, and a ring like member 11*a* has an inner diameter smaller than that of the tube 11*b*.

Figure 8:
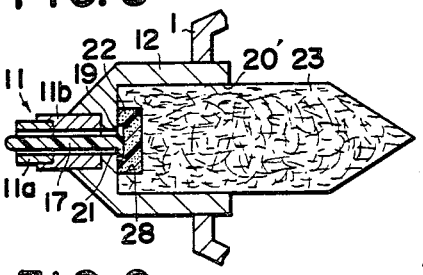
FIG. 8 is a sectional view of a modified structure of the writing instrument.

In FIG. 8 showing a further modification of the writing instrument, an ink-permeable resilient seat member 22 is connected to an ink-feed core 23 which is made of an acrylic resin or a bundle of acrylic fibers. The core 23 has a depression 28 at its end for securing therein the ink-permeable resilient seat member 22. A holder 12 has a concave 20′ and a shoulder 19′. Within the concave 20′, the core 23 which holds the ink-permeable resilient seat member 22 is held at is one end portion. The other elements such as elements 11*a*, 11*b*, 17 are substantially similar with those of the instrument shown in FIG. 1. The embodiment shown in FIG. 8 facilitates an easy assembly of the ink permeable resilient seat member 22 at the predetermined position of the concave portion of the holder 12 without involvement of substantial labour or difficulty since the resilient seat member 22 is very small and has, in general, a thickness of about 1 mm, and an outer diamter of about 1.5 to 2 mm.

Figure 9:
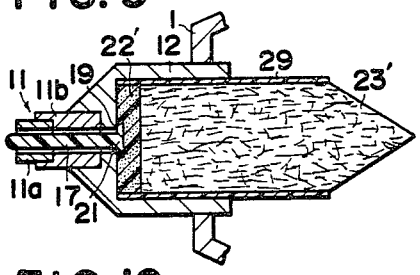
FIG. 9 is a sectional view of a further modified structure of the writing instrument.

FIG. 9 shows a further modification of the invention, in which an ink-permeable resilient seat member 22′ has a diameter substantially equal to the diameter of the core 23′, and both elements 22′ and 23′ are fixed together by a tubular member 29 made of heat-shrinkable resin. As will be understood from the drawing, the other structure is quite similar to the structure of FIG. 8, and any further detailed description will not be made. It will be also understood from the foregoing that the embodiments shown in FIGS. 8 and 9 permit an efficient operation of assembly since the ink permeable resilient seat members 22, 22′ are formed integral with the cores 23, 23′, respectively.

Figure 10:
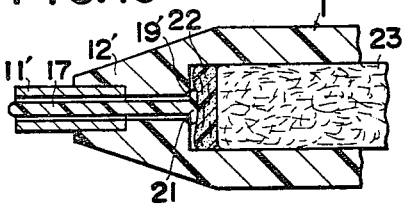
FIG. 10 is a sectional view of a writing instrument according to another embodiment of the invention.

FIG. 10 shows another embodiment of the invention, in which a barrel 1 made of synthetic resins has a holder portion 12′, which corresponds to the holder 12 of FIG. 1, integrally formed therewith, and the aforementioned ring like member 11*a* and the tube 11*b* are formed integral to form a holder tube 11′. In this embodiment, the ink-permeable resilient seat member 22 is formed of a mixture of foamed plastics and woven or non-woven fabrics. In the thus formed ink permeable resilient member, a permanent distortion or permanent set of the foamed plastics is restricted, and therefore the durability of the element 22 can be improved. Accordingly, desired restorations or responses to and from the writing nib 17 can be obtained. Besides, the ink-permeable resilient seat member 22 in this embodiment can maintain its shape, while foamed resin is likely to be deformed when it is wetted with fluid such as ink.

Figure 11:
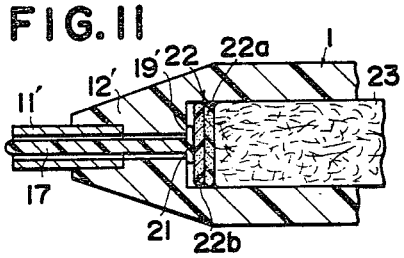
FIGS. 11 through 13 are sectional views of a writing instrument, showing an ink-permeable resilient member made of two parts.
Figure 12:
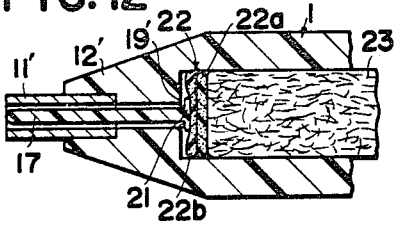
Figure 13:
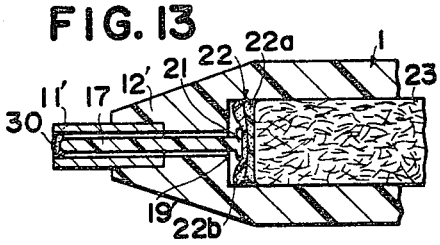

FIGS. 11, 12 and 13 show another embodiment of the invention in which an ink-permeable resilient seat member 22 is in the form of a block-like member made of two parts 22*a* and 22*b* which are different in resiliency or elastic properties from each other. The part 22*a* is made of a desired synthetic resin having a high resiliency and the part 22*b* is made of a synthetic resin of lower resiliency. When the writing instrument is not in use, the writing nib 17 is projected forwardly by the resilient force of the ink-permeable resilient member 22 such that the head 21 of the nib 17 is engaged with the shoulder 19' of the holder portion 12', as illustrated in FIG. 11. When the writing instrument is in use, the writing nib 17 is retracted by a writing pressure against the resilient force mainly of the less resilient part 22*b*.

FIG. 3 shows a state in which the writing nib 17 is retracted further due to clogging of foreign particles which are shown by reference numeral 30. In this case, the more resilient part 22*a* is also pressed by the head 21 of the nib 17 and deformed as illustrated, and the writing nib 17 is moved forward by a large resilient force of the part 22*a* to push the foreign particles out of the holder tube 11'.

Though not shown, the two parts 22*a*, 22*b* of the ink-permeable resilient member 22 may be formed integral. The integral resilient seat member 22 which has parts of high and low resiliency as described can be produced by a desired method such as changing the extent of foaming, and impregnating a resin into a part of the foamed resin.

Figure 14:
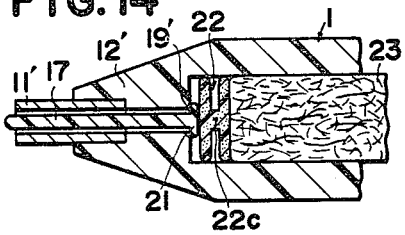
FIGS. 14 through 16 are sectional views of a writing instrument, showing a further modified structure of the ink-permeable resilient member.
Figure 15:
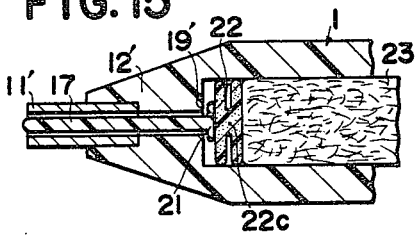
Figure 16:
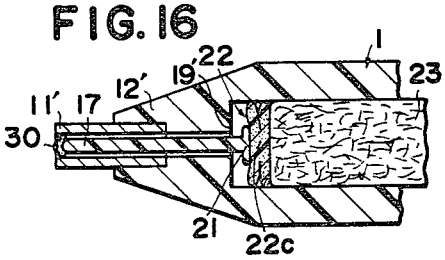

FIGS. 14, 15 and 16 show a modified form of the aforesaid ink-permeable resilient seat member 22. As illustrated the ink-permeable resilient member seat 22 is in the form of a block-like member which has an "H" shape in cross section. FIG. 14 shows a state in which the writing nib 17 is projected forward by the resilient force of the H shaped resilient seat member 22 such that the head 21 is engaged with the shoulder 19'. When a writing pressure is added to the tip of the writing nib 17 as illustrated in FIG. 15, the nib is retracted against the resilient force of the resilient seat member 22. In this instance, the substantial resilient force of the member 22 is given by a central portion 22*c*. When the writing nib 17 is retracted further due to clogging of foreign particles 30 at the tip of the holder tube 11', the resilient member 22 is totally depressed and deformed as illustrated in FIG. 16. In this instance, it will be understood that resilient force applied to the head 21 of the writing nib 17 rapidly increases, and the writing nib 17 is moved forward to push the foreign particles out of the holder tube 11' of the writing instrument.

It will be understood from the foregoing that the holder tube 11(11') plays the role of an actual writing tip to contact a writing surface in combination with the tip 16 of the nib 17 which will be retracted by a writing pressure against the resilient force of the resilient seat member 22. When the writing instrument is in use in such a manner that an axis of the writing instrument is vertical relative to a writing surface, the nib 17 will be retracted to such an extent that the tip 16 of the nib will be substantially aligned with the fore end of the holder tube 11(11').

Though the present invention has been described with reference to preferred embodiments thereof, many modifications and alterations may be made within the spirit of the invention.

For example, the resilient member 22 is not necessarily made of an ink permeable material, but may be made of non-permeable material such as rubber. In this case, a minor space (not shown) is formed between the material and the holder 12 so that ink can pass therethrough.

What is claimed is:

1. A writing instrument comprising:

a barrel having therein an ink reservoir;

a nib holder body extending from a fore end of said barrel;

a longitudinal nib member positioned within said nib holder body for longitudinal displacement with respect thereto between an inner position and an outer position;

said nib member having at a rear end thereof an enlarged head portion;

a resilient seat member comprising a block formed of an ink permeable material, mounted within said nib holder body and resiliently contacted with said head portion, for urging said nib member toward said outer position thereof until said head portion abuts against said nib holder body, whereat a fore end of said nib member projects forwardly from said nib holder body, whereby when a writing pressure from a writing surface is longitudinally applied to said fore end of said nib member, said nib member moves against the resilient force of said seat member to said inner position, whereat said head portion is spaced from and out of contact with said nib holder body; and said nib member and said nib holder body being dimensioned such that when said nib member is in said inner position thereof due to the writing pressure, both said nib member and said nib holder body are in contact with the writing surface and function as a writing tip.

2. A writing instrument as claimed in claim 1, wherein said nib member includes longitudinal grooves extending along the entire length thereof, except for the portion including said enlarged head portion, said grooves extending radially and being spaced at constant intervals.

3. A writing instrument as claimed in claim 1, wherein said barrel has therein an ink carrier and an ink feed member connected at one end thereof to said ink carrier, said nib holder body comprises a conical member having therein a hole extending in the axial direction thereof and a concave portion coaxially connected to said hole, said ink feed member being mounted at a second end thereof to said conical member, said resilient seat member being secured within said concave portion, and a tubular body immovably fixed with respect to said conical member and coaxially secured in said hole of said conical member, said nib member being axially displaceable within said tubular body.

4. A writing instrument as claimed in claim 1, wherein said barrel includes therein an ink carrier, and an ink feed member connected at one end thereof to said resilient seat member and at a second end thereof to said ink carrier.

5. A writing instrument as claimed in claim 4 wherein said ink feed member has a recess for nesting therein said resilient seat member.

6. A writing instrument as claimed in claim 4 further comprising a tube of a heat-shrinkable resin material connecting said ink feed member and said resilient seat member together in a facewise relation.

7. A writing instrument comprising:

a barrel having therein an ink reservoir;

a nib holder body extending from a fore end of said barrel;

a longitudinal nib member positioned within said nib holder body for longitudinal displacement with respect thereto between an inner position and an outer position;

said nib member having at a rear end thereof an enlarged head portion;

a resilient seat member comprising a block formed of an ink permeable material, mounted within said nib holder body and resiliently contacted with said head portion, for urging said nib member toward said outer position thereof until said head portion abuts against said nib holder body, whereat a fore end of said nib member projects forwardly from said nib holder body, whereby when a writing pressure from a writing surface is longitudinally applied to said fore end of said nib member, said nib member moves against the resilient force of said seat member to said inner position, whereat said head portion is spaced from and out of contact with said nib holder body;

said nib member and said nib holder body being dimensioned such that when said nib member is in said inner position thereof due to writing pressure, both said nib member and said nib holder body are in contact with the writing surface and function as a writing tip; and said resilient seat member being made of a mixture of foamed plastics and fabrics and having two parts, one of said two parts having a higher resiliency than the other.

8. A writing instrument as claimed in claim 7, wherein said two parts are integrally formed.

9. A writing instrument comprising:

a barrel having therein an ink carrier and an ink feed member connected at one end thereof to said ink carrier;

a nib holder body extending from a fore end of said barrel, said nib holder body comprising a conical member having therein a hole extending in the axial direction thereof and a concave portion coaxially connected to said hole, said ink feed member being mounted at a second end thereof to said conical member;

a longitudinal nib member positioned within said nib holder body for longitudinal displacement with respect thereto between an inner position and an outer position, said nib member having at a rear end thereof an enlarged head portion;

a tubular body immovably fixed with respect to said conical member and coaxially secured in said hole of said conical member, said nib member being axially displaceable within said tubular body, said tubular body including a tubular member formed of ceramic material and a steel pipe, said tubular member and said pipe being connected together such that said tubular member projects forwardly from said pipe;

a resilient seat member comprising a block made of an ink permeable material, mounted within said nib holder body, secured within said concave portion and resiliently contacted with said head portion, for urging said nib member toward said outer position thereof until said head portion abuts against said nib holder body, whereat a fore end of said nib member projects forwardly from said nib holder body, whereby when a writing pressure from a writing surface is longitudinally applied to said fore end of said nib member, said nib member moves against the resilient force of said seat member to said inner position, whereat said head portion is spaced from and out of contact with said nib holder body; and said nib member and said nib holder body being dimensioned such that when said nib member is in said inner position thereof due to the writing pressure, both said nib member and said nib holder body are in contact with the writing surface and function as a writing tip.

* * * * *